US005171615A

United States Patent [19]

Cohen et al.

[11] Patent Number: 5,171,615

[45] Date of Patent: Dec. 15, 1992

[54] ARTIFICIAL FROND FOR USE WITH ARTIFICIAL PLANTS AND METHOD OF MAKING THE SAME

[75] Inventors: Richard E. Cohen, Elkins Park; John A. Baum, Glenside, both of Pa.

[73] Assignees: HMS Associates Company, Willow Grove, Pa.; The Larson Company, Tuscon, Ariz.

[21] Appl. No.: 666,823

[22] Filed: Mar. 8, 1991

[51] Int. Cl.[5] ..... A41G 1/00

[52] U.S. Cl. ..... 428/18; 156/61

[58] Field of Search ..... 428/17, 18, 21; 156/61

[56] References Cited

U.S. PATENT DOCUMENTS

| | | | |
|---|---|---|---|
| 1,150,027 | 8/1915 | Gates | 428/17 |
| 1,273,384 | 7/1918 | Lesem | 428/21 X |
| 2,070,825 | 2/1937 | Buhrow | 428/18 X |
| 3,144,375 | 8/1964 | Day | 428/18 |
| 3,644,164 | 2/1972 | Chin | 428/21 |
| 4,585,677 | 4/1986 | Hwang et al. | 156/61 X |
| 4,727,672 | 3/1988 | Hill et al. | 428/17 X |
| 4,808,446 | 2/1989 | Weitz | 428/17 |
| 4,855,166 | 8/1989 | Allison | 428/15 |
| 5,047,268 | 9/1991 | Cheng | 156/61 X |
| 5,085,900 | 2/1992 | Hamlett | 428/18 |

*Primary Examiner*—Henry F. Epstein

*Attorney, Agent, or Firm*—Panitch Schwarze Jacobs & Nadel

[57] ABSTRACT

An artificial frond for use with artificial plants has an elongate rod for providing structural integrity. A plurality of elongate leaves, each having a first end in engagement with the rod, extend outwardly from the rod. The first end of each of the leaves includes an aperture extending therethrough. The rod extends through the aperture of each of the leaves for attaching the leaves to the rod. A stem portion surrounds the rod and is in engagement with the first end of the leaves for firmly securing the leaves to the rod such that the stem portion and the leaves are formed generally in the shape of a frond.

16 Claims, 2 Drawing Sheets

ARTIFICIAL FROND FOR USE WITH ARTIFICIAL PLANTS AND METHOD OF MAKING THE SAME

FIELD OF THE INVENTION

The present invention relates to an artificial frond for use with artificial plants and, more particularly, to an artificial palm frond for use with artificial palm trees and method of making the same.

BACKGROUND OF THE INVENTION

It is well known that artificial fronds for artificial plants are used outdoors for beautifying and landscaping home and estate lawns, boulevard margins, center parkways, public park grounds and areas where natural trees are customarily used. Such artificial plants are equally well adapted for indoor decorative use when desired.

Artificial plants have been made and utilized for a number of years. Usually these have taken the form of a number of blade-like leaf portions of vinyl or other synthetic sheet material which, at their lower ends, are bunched together about a supporting stem member of wire, plastic or wire-reinforced plastic. The lower ends of the leaf portions are secured to the stem member by means of an adhesive strip or length of malleable wire wound about the bunched together lower ends of the leaf members.

It is also known to simultaneously form a large number of leaves or petals of an artificial plant by cutting a flexible sheet of fabric or the like along approximately parallel lines which extend a substantial part of the distance across the sheet so as to define a large number of petal or leaf portions integral, at one end, with a connecting strip. The connecting strip is then wrapped about a stem member of wire or the like and secured thereto by a malleable wire wrapping so that the petal or leaf portions are arrayed about and extend from the supporting stem member.

However, in the foregoing known arrangements, the wrapping of the connecting strip and/or lower ends of the leaves about the supporting stem or wire and the secure attachment thereto requires considerable time, skill and manual dexterity, and it is difficult to provide a product of uniform high quality. Further, such connection systems lack the structural integrity to withstand rigors of outdoor use. That is, artificial plants which are permanently placed outdoors must have sufficient strength to withstand inclement weather, such as high winds, driving rain storms and hail storms.

The present invention overcomes many of the disadvantages inherent in the above-described artificial plants by providing an artificial frond which is easy to manufacture and durable enough to withstand inclement weather due to outdoor use. The artificial leaves of the present invention are secured together by an elongate rod and stem portion. The stem portion surrounds the rod and is in engagement with the leaves for firmly securing the leaves to the rod. Use of the present invention results in an artificial frond which is considerably stronger than prior art artificial fronds, is easy to construct and represents actual fronds with a high degree of accuracy.

SUMMARY OF THE INVENTION

Briefly stated, the present invention comprises an artificial frond for use with artificial plants wherein the artificial frond includes an elongate rod for providing structural integrity. A plurality of elongate leaves each have a first end in engagement with the rod and extend outwardly from the rod. A stem portion surrounds the rod and is in engagement with the first end of each of the leaves for firmly securing the leaves to the rod whereby the stem portion and the leaves are formed generally in the shape of a frond.

BRIEF DESCRIPTION OF THE DRAWINGS

The foregoing summary, as well as the following detailed description of the preferred embodiment will be better understood when read in conjunction with the appended drawings. For the purpose of illustrating the invention, there is shown in the drawings an embodiment which is presently preferred. It is understood, however, that this invention is not limited to the specific methods and instrumentalities disclosed. In the drawings.

DESCRIPTION OF THE PREFERRED EMBODIMENT

Figure 1:
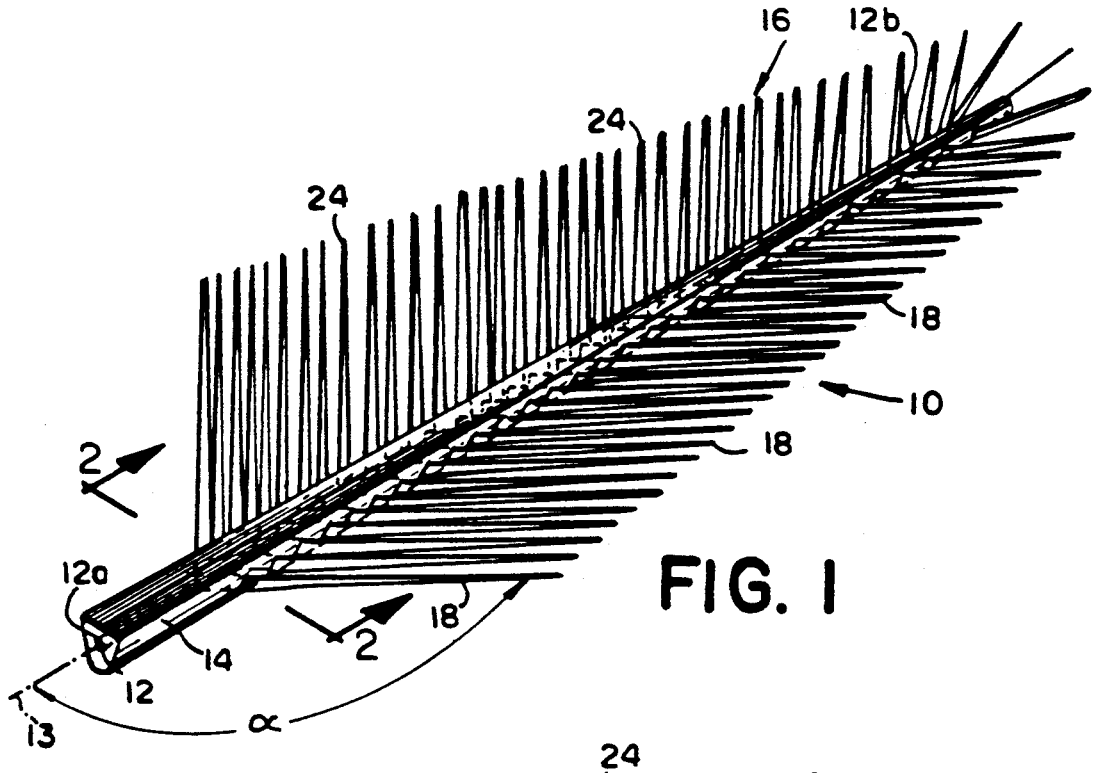
FIG. 1 is perspective view of an artificial frond in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the artificial frond and designated parts thereof. The terminology includes the words above specifically mentioned, derivatives thereof and words of similar import.

Figure 2:
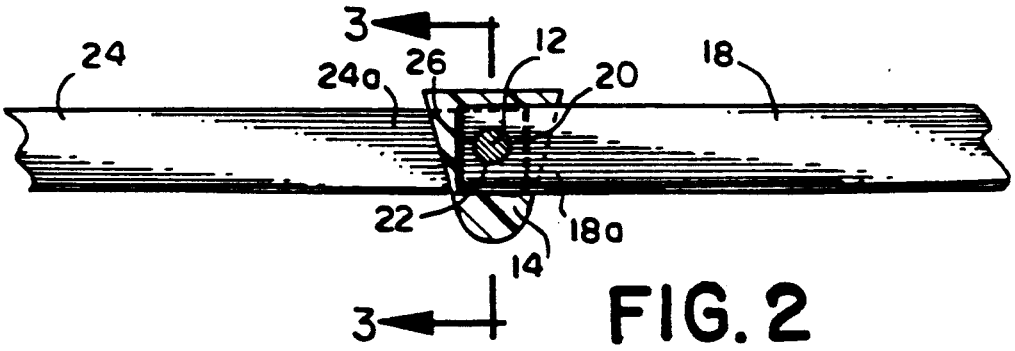
FIG. 2 is a greatly enlarged partial cross-sectional view of the artificial frond of FIG. 1 taken along lines 2—2 of FIG. 1.
Figure 3:
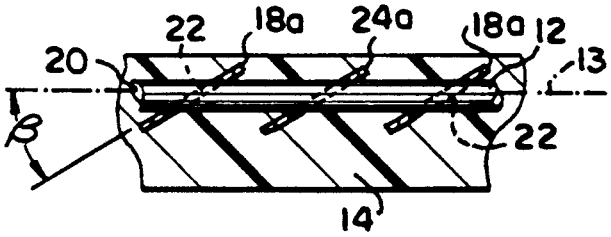
FIG. 3 is a partial cross-sectional view of the artificial frond shown in FIG. 2 taken along lines 3—3 of FIG. 2.

Referring to the drawings in detail, wherein like numerals indicate like elements throughout, there is shown in FIGS. 1 through 3 a preferred embodiment of an artificial frond 10 in accordance with the present invention. In the present embodiment, it is preferred that the artificial frond 10 be an artificial palm frond for use with artificial palm trees (not shown). However, it is understood by those skilled in the art that the present invention is not limited to any particular type of frond or plant therefor and that it is equally applicable to other artificial fronds and plants, such as ferns (not shown).

Referring now to FIGS. 1 through 3, the artificial frond 10 includes an elongate rod 12 having a proximal end 12*a* and a distal end 12*b* for providing structural integrity. In the present embodiment, it is preferred that the rod 12 extend the entire length of the stem portion 14 of the artificial frond 10 for providing the stem portion 14 with a desired amount of rigidity. As shown in FIGS. 2 and 3, it is preferred that the rod 12 be completely positioned within the stem portion 14 so that the rod 12 is not viewable to thereby enhance the overall aesthetic appearance of the artificial frond 10.

While it is preferred that the rod 12 extend the entire length of the stem portion 14, it is understood by those skilled in the art that the rod 12 could extend only a portion of the length thereof. Moreover, it is understood by those skilled in the art that more than one rod 12 can extend along the length of the stem portion. For instance, a pair of juxtaposed rods (not shown) could extend along the length of the stem portion each for receiving a different set of leaves (not shown). Furthermore, a plurality of aligned rods could be spaced along the length of the stem portion 14 for increasing the overall flexibility of the artificial frond 10.

As shown in FIG. 2, the rod 12 is preferably generally circular in cross section. However, it is understood by those skilled in the art that the rod 12 could be configured in other cross-sectional configurations, including square or triangular without departing from the spirit or scope of the invention. The rod 12 is preferably constructed of a high strength lightweight metallic material, such as steel. Again, one of ordinary skill in the art understands that the rod 12 could be constructed of other materials, including other metals or polymers.

As shown in FIG. 1, a plurality of elongate leaves 16 each have a first end in engagement with the rod 12. The leaves 16 preferably extend outwardly from the rod 12. That is, the elongate leaves preferably extend outwardly from the rod 12 such that they lie in the same general plane and are positioned at an angle with respect to the longitudinal axis 13 of the rod 12. More particularly, an obtuse angle $\alpha$ is formed between each of the leaves 16 and the longitudinal axis 13 of the rod 12. In addition, as best shown in FIG. 3, each of the leaves 16 is twisted about the longitudinal axis thereof to form an angle $\beta$ between the plane of each leaf and the longitudinal axis 13 of the rod 12. Both of the angles $\alpha$ and $\beta$ of the leaves 16 are selected to assume the appearance of a real palm frond. Accordingly, in the present embodiment it is preferred that the leaves 16 be shaped generally in the form of palm leaves, as is understood by those skilled in the art.

Referring now to FIGS. 1 and 2, the plurality of elongate leaves 16 is preferably comprised of a first plurality of elongate leaves 18 each having a first end 18*a* in engagement with the rod 12 and extending outwardly from a first side 20 of the rod 12. As shown in FIG. 2, the first end 18*a* of each of the first plurality of leaves 18 includes an aperture 22 extending therethrough. The aperture 22 is preferably complementarily sized to receive the rod 12 therein. That is, the aperture 22 is preferably shaped to allow the rod 12 to extend through the aperture 22 of each of the first plurality of leaves 18 at the angle $\alpha$ and for attaching the leaves 18 to the rod 12.

As shown in FIG. 1, the frond 10 includes a second plurality of elongate leaves 24 each having a first end 24*a* in engagement with the rod 12. However, the second plurality of leaves 24 extends outwardly from a second side 26 of the rod 12. The second plurality of leaves 22 is generally identical to the first plurality of leaves 18 except as indicated otherwise herein.

Figure 5:
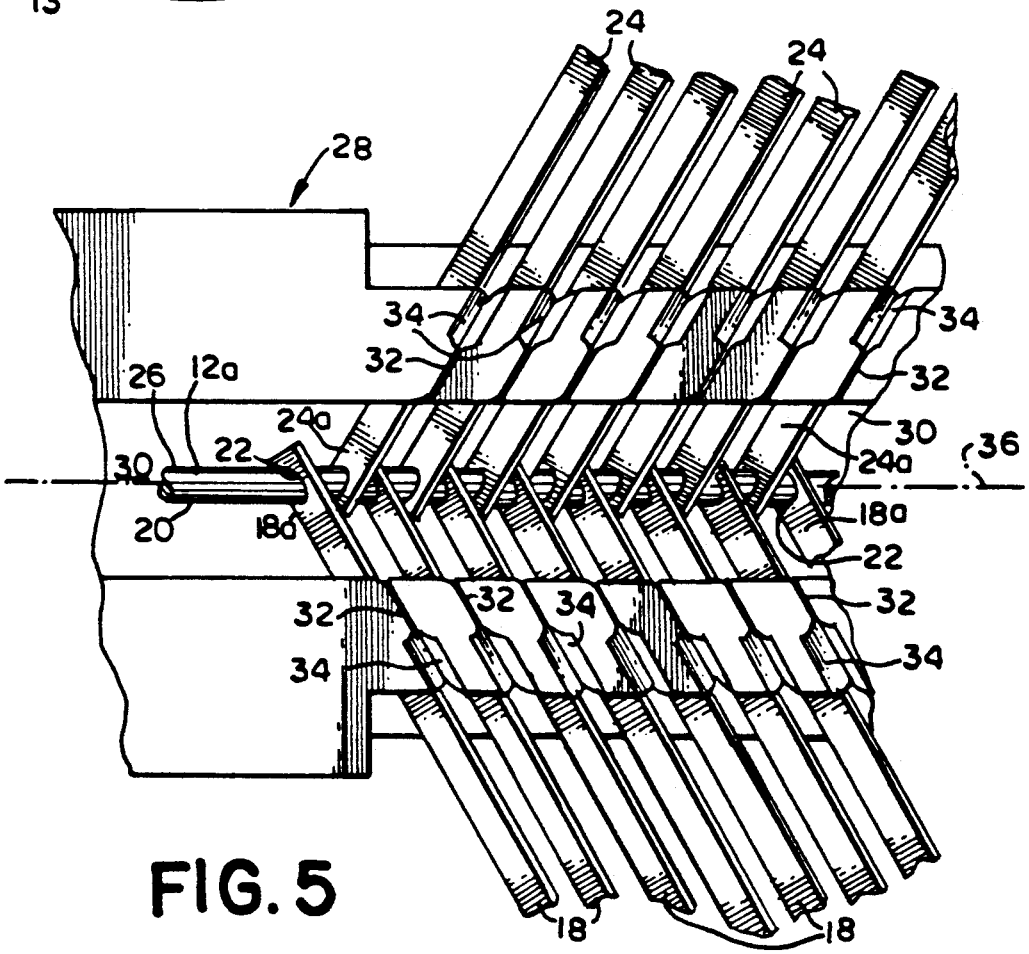
FIG. 5 is a greatly enlarged partial top plan view showing a portion of the mold of FIG. 4 having a partially assembled artificial frond therein.

As best shown in FIGS. 1 and 5, the first plurality of leaves 18 is spaced generally equidistantly along a length of the rod 12. Similarly, the second plurality of leaves 24 is spaced generally equidistantly generally along the same length of the rod 12. In the present embodiment, it is preferred that the first and second plurality of leaves 18, 24 be alternately spaced along the length of the rod 12, as best shown in FIG. 5. While it is preferred that the first and second plurality of leaves 18, 24 be equidistantly and alternately spaced along the length of the rod 12, it is understood by those skilled in the art that the first and second plurality of leaves 18, 24 can be spaced along the length of the rod 12 in any manner. For instance, each of the first and second plurality of leaves 18, 24 could be formed as a single piece (not shown) having a single aperture extending therethrough such that the leaves extend from the rod 12 at the same positions.

As best shown in FIG. 1, the first and second plurality of leaves 18, 24 do not extend along the entire length of the rod 12. That is, the proximal end 12*a* of the rod 12 extends beyond the first and second plurality of leaves 18, 24 for purposes of connecting the artificial frond 10 to a tree or the like (not shown). However, it is understood by those skilled in the art that the first and second plurality of leaves 18, 24 could extend along the entire length of the rod 12 without departing from the spirit and scope of the invention.

As mentioned previously, the first plurality of leaves 18 extends from a first side 20 of the rod 12 and the second plurality of leaves 2 extends from the second side 26 of the rod 12. In the present embodiment, it is preferred that the first and second sides 20, 26 of the rod 12 be generally oppositely disposed, as shown in FIG. 2. While it is preferred that the first and second plurality of leaves 18, 24 extend from opposite sides of the rod 12, it is understood by those skilled in the art that the first and second plurality of leaves 18, 24 can extend from any side of the rod 12, that any number of a plurality of leaves can extend from any side of the rod 12 and that the leaves 18, 24 can extend at any angle with respect to the longitudinal axis 13 and with respect to each other, as desired, without departing from the spirit and scope of the invention.

The first and second plurality of leaves 18, 24 are preferably constructed from a polymeric material, such as polypropylene. More particularly, it is preferred that the first and second plurality of leaves 18, 24 be die cut from a sheet of polypropylene having a thickness of approximately one-eighth of an inch. However, it is understood by those skilled in the art that the first and second plurality of leaves 18, 24 could be constructed of other materials, such as high impact styrene, vinyl, or other polymeric materials. Similarly, it is understood that the first and second plurality of leaves 18, 24 can be fabricated with other methods, such as by injection molding. Accordingly, the present invention is not limited to any particular type of material for the leaves or any particular method of fabricating the leaves.

As best shown in FIG. 1, it is preferred that the length of the first and second plurality of leaves 16 becomes uniformly shorter as the leaves 18, 24 approach the distal end 12*b* of the rod 12. However, it is understood by those skilled in the art that the leaves 18, 24 can extend any length from the rod 12 without departing from the spirit and scope of the invention.

Referring now to FIGS. 1–3, the stem portion 14 surrounds the rod 12 and is in engagement with the first ends 18*a*, 24*a* of each of the first and second plurality of leaves 18, 24 for firmly securing the first and second plurality of leaves 18, 24 to the rod 12 such that the stem portion 14 and the first and second plurality of leaves 18, 24 are formed generally in the shape of a palm frond. In the present embodiment, the stem portion 14 is constructed of a bonding material molded generally in the shape of a stem of a frond, as described in more detail hereinafter. It is preferred that the bonding material be a semirigid, flexible urethane suitable for molding such as that sold by Smooth On, Inc. located in Gillette, New Jersey as Model No. C1511. However, it is understood by those skilled in the art that the stem portion 14 could be constructed of other materials, such as elastomers and resins without departing from the spirit and scope of the invention.

Figure 4:
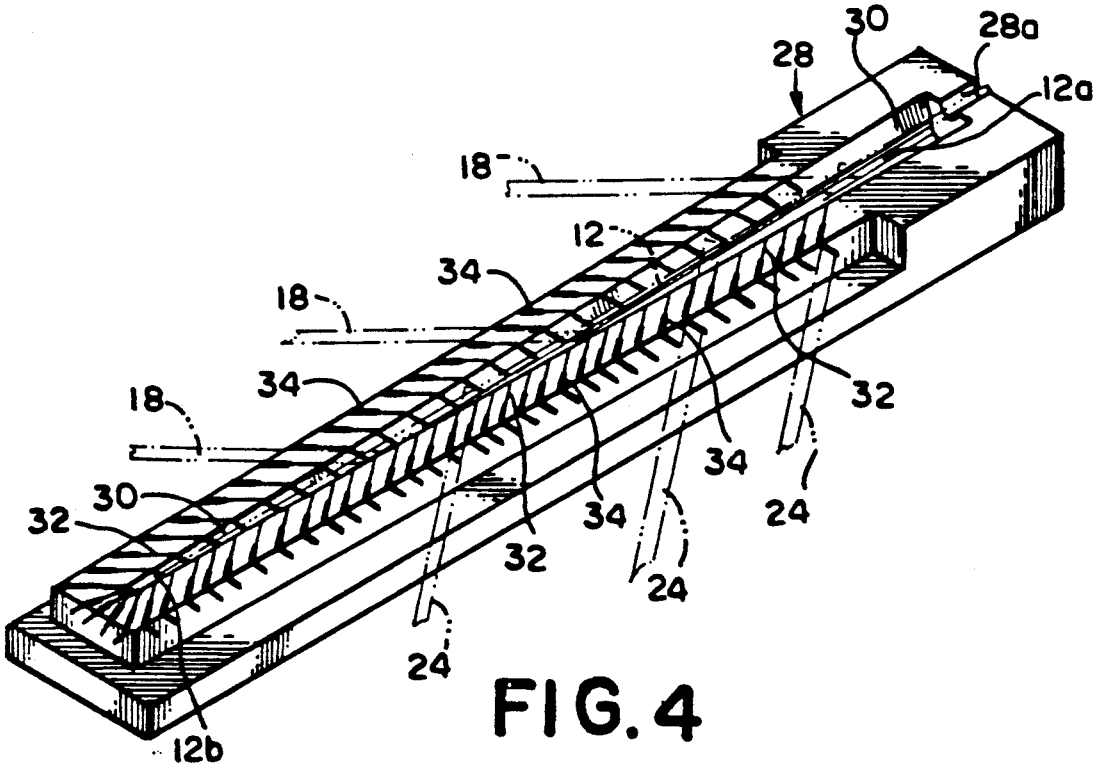
FIG. 4 is a perspective view of a mold in accordance with the present invention used for constructing the artificial frond of FIG. 1.

Referring now to FIGS. 4 and 5, a mold 28 is provided for making the artificial frond 10. The mold 28 includes a cavity or stem forming portion 30 and a plurality of slots or leaf holding portions 32 extending outwardly from the stem forming portion 30. As shown in FIG. 4, the stem forming portion 30 extends generally along the length of the mold 28. The leaf holding portions 32 include a chamfered portion 34 along the upper surface thereof for purposes of initially guiding the first ends 18*a*, 24*a* of the first and second plurality of leaves 18, 24 through each leaf holding portion 32.

In the present embodiment, it is preferred that the mold 28 be formed of a standard mold material, such as urethane. More particularly, it is preferred that the mold 28 be formed of a flexible urethane which is cast from a master stem model (not shown). However, it is understood by those skilled in the art that the mold 28 can be formed of other materials, such as steel, and be constructed in other manners, such as by machining.

As shown in FIG. 5, the first and second plurality of leaves 18, 24 are positioned in a predetermined manner. That is, the first and second plurality of leaves 18, 24 are positioned in a corresponding plurality of the leaf holding portions 32 with the first ends thereof 18*a*, 24*a* located within the stem forming portion 30 such that the apertures 22 are aligned along a common axis 36.

The rod 12 is then positioned in engagement with the first end 18*a*, 24*a* of each of the first and second plurality of leaves 18, 24 such that the leaves extend outwardly from the rod 12. More particularly, after the apertures 22 are aligned along the common axis 36, the rod 12 is slid through the open end 28*a* of the mold 28 along the common axis 36 through each aperture 22 until all of the first and second plurality of leaves 18, 24 are in engagement with the rod 12, as best shown in FIG. 5. That is, the rod 12 is positioned within the stem forming portion 30 along the common axis 36 such that the rod 12 extends through all of the apertures 22.

To complete the artificial frond 10, the stem portion 14 is molded around the rod 12 and the first end 18*a*, 24*a* of each of the first and second plurality of leaves 18, 24 for firmly securing the leaves to the rod 12. More particularly, liquid urethane is deposited into the stem forming portion 30 for bonding the rod 12 and the first and second plurality of leaves 18, 24 together. The stem forming portion 30 of the mold 28 forms the urethane generally in the shape of a stem of a frond such that the stem portion 14 and the first and second plurality of leaves 18, 24 are formed generally in the shape of a palm frond. After the urethane solidifies, the artificial frond 10 can be removed from the mold 28 and is ready for use.

From the foregoing description, it can be seen that the present invention comprises an artificial frond for use with artificial plants and method of making the same. It will be appreciated by those skilled in the art that changes could be made to the embodiment described above without departing from the broad inventive concept thereof. It is understood, therefore, that this invention is not limited to the particular embodiment disclosed, but it is intended to cover all modifications and artificial plants which are within the scope and spirit of the invention, as defined by the appended claims.

We claim:

1. An artificial frond for use with artificial plants, said artificial frond comprising:

an elongate rod for providing structural integrity;

a plurality of elongate leaves each having a first end in engagement with said rod and extending outwardly from said rod; and a stem portion surrounding said rod and being in overlaying engagement with said first end of said leaves for firmly securing said leaves to said rod whereby said stem portion and said leaves are formed generally in the shape of a frond.

2. The artificial frond as recited in claim 1 wherein said first end of each of said leaves includes an aperture extending therethrough, said aperture being sized to complementarily receive said rod therein, said rod extending through the aperture of each of said leaves for attaching said leaves to said rod.

3. The artificial frond as recited in claim 1 wherein said stem portion is constructed of a bonding material molded generally in the shape of a stem of a frond.

4. The artificial frond as recited in claim 3 wherein said bonding material is a urethane.

5. An artificial frond for use with artificial plants, said artificial frond comprising:

an elongate rod for providing structural integrity;

a first plurality of elongate leaves each having a first end in engagement with said rod and extending outwardly from a first side of said rod, said first plurality of leaves being spaced along the length of said rod;

a second plurality of elongate leaves each having a first end in engagement with said rod and extending outwardly from a second side of said rod, said second plurality of leaves being spaced along a length of said rod; and a stem portion surrounding said rod and being in overlaying engagement with said first end of said first and second plurality of leaves for firmly securing said first and second plurality of leaves to said rod whereby said stem portion and said first and second plurality of leaves are formed generally in the shape of a frond.

6. The artificial frond as recited in claim 5 wherein said first and second plurality of leaves are alternately spaced along said length of said rod.

7. The artificial frond as recited in claim 5 wherein said first end of each of said first and second plurality of leaves includes an aperture extending therethrough, said aperture being sized to complementarily receive said rod therein, said rod extending through said aperture of each of said first and second plurality of leaves for attaching said leaves to said rod.

8. The artificial frond as recited in claim 5 wherein said stem portion is constructed of a bonding material molded generally in the shape of a stem of a frond.

9. The artificial frond as recited in claim 8 wherein said bonding material is a urethane.

10. The artificial frond as recited in claim 5 wherein said first and second sides of said rod are generally oppositely disposed.

11. The artificial frond as recited in claim 5 wherein said first and second plurality of leaves are shaped generally in the form of palm leaves.

12. An artificial palm frond for use with artificial palm trees, said artificial palm frond comprising:

an elongate rod for providing structural integrity;

a first plurality of elongate palm leaves each having a first end in engagement with said rod and being spaced generally equidistantly along a length of said rod, said first plurality of leaves extending outwardly from a first side of said rod;

a second plurality of elongate palm leaves each having a first end in engagement with said rod and being spaced generally equidistantly along said length of said rod, said second plurality of leaves extending outwardly from a second side of said rod, said first and second plurality of leaves being alternatively spaced along said length; and a stem portion surrounding said rod and being in overlaying engagement with said first end of said first and second plurality of leaves for firmly securing said first and second plurality of leaves to said elongate rod, said stem portion being generally formed in the shape of a stem of a palm frond whereby said stem portion and said first and second plurality of leaves are formed generally in the shape of a palm frond.

13. A method of making an artificial frond for use with artificial plants, said method comprising the steps of:

positioning a plurality of elongate leaves each having a first end in a predetermined manner;

positioning an elongate rod in engagement with said first end of each of said plurality of leaves such that said leaves extend outwardly from said rod; and molding a stem portion around said elongate rod and said first end of each of said leaves for firmly securing said leaves to said rod whereby said stem portion and said leaves are formed generally in the shape of a frond.

14. The method as recited in claim 13 wherein the first end of the leaves includes an aperture extending therethrough and the step of positioning the plurality of elongate leaves in a predetermined manner further comprises:

aligning the apertures along a common axis for receiving the rod therethrough.

15. The method as recited in claim 14 wherein the step of positioning the elongate rod comprises sliding the rod through each aperture until all of the leaves are in engagement with the rod.

16. A method of making an artificial frond for use With artificial plants, said method comprising the steps of:

providing a mold having a stem forming portion and a plurality of leaf holding portions extending outwardly from said stem forming portion;

positioning a plurality of elongate leaves each having a first end with an aperture extending therethrough in a corresponding plurality of said leaf holding portions with said first end located within said stem forming portion such that said apertures are aligned along a common axis;

positioning an elongate rod within said stem forming portion along said common axis such that said rod extends through said apertures;

depositing a bonding material into said stem forming portion for bonding said rod and said leaves together, said stem forming portion of said mold forming said bonding material generally in the shape of a stem of a frond whereby said bonding material and said leaves are formed generally in the shape of a frond.

* * * * *